US007833082B2

(12) United States Patent
Bugada

(10) Patent No.: US 7,833,082 B2
(45) Date of Patent: Nov. 16, 2010

(54) BRASSIERE

(75) Inventor: Andrea Bugada, Ponte S. Pietro (IT)

(73) Assignee: DBA Lux 1 Sarl, Luxembourg (LU)

( * ) Notice: Subject to any disclaimer, the term of this patent is extended or adjusted under 35 U.S.C. 154(b) by 481 days.

(21) Appl. No.: 11/142,845

(22) Filed: Jun. 1, 2005

(65) Prior Publication Data

US 2007/0021035 A1 Jan. 25, 2007

(51) Int. Cl.
*A41C 3/00* (2006.01)

(52) U.S. Cl. ..... 450/39; 450/92; 450/93; 450/41

(58) Field of Classification Search ..... 450/92, 450/93, 39, 54–57, 41
See application file for complete search history.

(56) References Cited

U.S. PATENT DOCUMENTS 4,701,964 A * 10/1987 Prunesti et al. ..... 2/406
5,820,443 A 10/1998 Burr
6,000,994 A * 12/1999 Salotto ..... 450/92
6,238,266 B1 5/2001 Vogt
6,332,825 B1 * 12/2001 Henricksen ..... 450/81
6,769,358 B2 * 8/2004 Jordan ..... 101/129

FOREIGN PATENT DOCUMENTS

EP 0516994 12/1992
EP 0852915 7/1998
WO WO 01/08516 2/2001

OTHER PUBLICATIONS

International Search Report corresponding to PCT International Application No. PCT/IB02/05147 dated May 12, 2002.

* cited by examiner

*Primary Examiner*—Gloria Hale
(74) *Attorney, Agent, or Firm*—Ohlandt, Greeley, Ruggiero & Perle, LLP

(57) ABSTRACT

A brassiere has two cups of fabric connected to each other and two side bands, which extend from the cups and are suitable for connecting to each other. Reinforcing portion has at least one layer of chemical material suitable for being applied along at least an edge portion of the cups and for forming an integral part of the fabric. The material has a polyurethane mix or a silicone mix. The layer is applied at least along a side portion of the edge of each cup which faces towards the respective band and extends with no break in continuity at least as far as the point of connection to a shoulder strap, wrapping around the respective cup at the side. Moreover, the layer is applied at least along a lower portion of the edge of each cup, wrapping around the respective cup at the bottom and at the side.

29 Claims, 4 Drawing Sheets

BRASSIERE

BACKGROUND OF THE INVENTION

1. Field of the Invention

This invention relates to a brassiere comprising two fabric cups connected to each other and two side bands which extend from the cups and are suitable for connecting to each other.

2. Description of the Related Art

Brassieres of the type indicated above are known in which wires, stitching or other similar solutions are provided as reinforcing and support elements to be applied to the edges which delimit the cups.

The application of such elements and the use of the brassieres thus obtained, while partly solving the problem of supporting and reinforcing the cups, do have some disadvantages.

Firstly, various successive manufacturing steps are required, following which the wire is applied to the lower portion of the cups. Secondly, the brassiere which is obtained has parts that are very rigid, limits its wearability, and very thick compared with the remaining fabric part.

The problem underlying this invention is that of proposing a brassiere which has structural and functional characteristics such as to overcome the above-mentioned disadvantages cited with reference to prior art while still solving the requirement to provide a reinforcing and supporting effect for the cups.

SUMMARY OF THE INVENTION

This problem is solved by means of a brassiere of the type specified above, according to claim 1.

DESCRIPTION OF THE DRAWINGS

Further characteristics and advantages of the brassiere according to the invention will become clear from the following description of preferred examples of embodiment of the invention given with reference to the appended drawings which are provided by way of non-limiting example, and in which.

DESCRIPTION OF THE INVENTION

Figure 1:
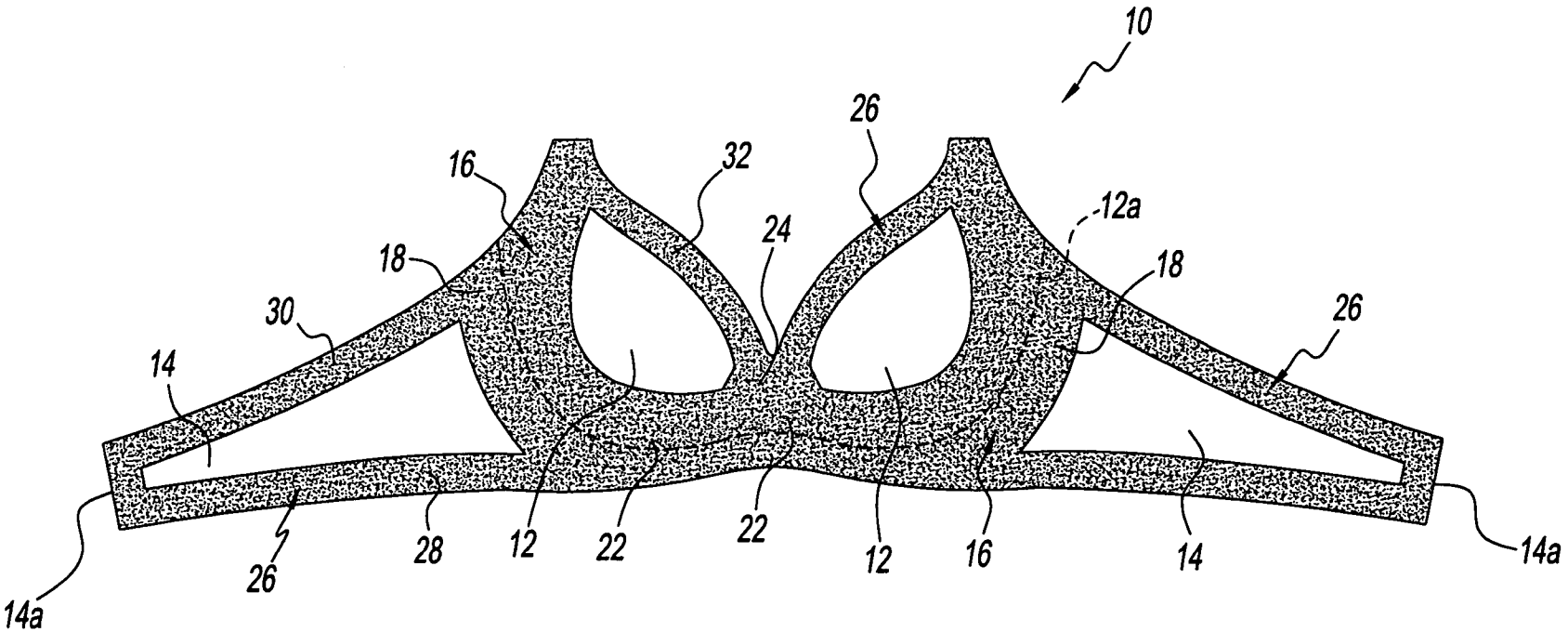
FIG. 1 illustrates a front view partly in perspective of an element of a brassiere according to the present invention.

With reference to the above-mentioned drawings, the number 10 indicates a brassiere as a whole, the basic structure of which is shown schematically in FIG. 1.

In what follows, the terms top or upper and bottom or lower refer to the brassiere as worn. Therefore, the top or upper part of the brassiere is for example the part pertaining to the area from which the shoulder straps, if any, run, while the bottom or lower part is the opposite one.

The brassiere 10 comprises two cups made of fabric and connected to each other. In the Figures, the number 12 indicates the cups, that is a portion substantially extending between the upper portion of the brassiere and an edge 12*a* shown in dotted line in FIG. 1. According to a possible embodiment, shown in the drawings, for example, the two cups are made in one piece from the same fabric.

In the examples shown, the number 14 refers to the side bands which extend sideways from the cups and are suitable for connecting to each other for example by hooking means, not shown, suitable for attaching to a free end 14*a* of said bands.

The brassiere according to the invention advantageously comprises reinforcing means comprising at least one layer 16 of chemical material suitable for being applied along at least a portion of the edge 12*a* of the cups 12 and partially extending inward and outward in respect of the cup. In particular, as will be better disclosed subsequently, the layer 16 is suitable for being applied along a lower portion and/or a side portion of the cup. Said layer 16 is advantageously suitable for forming an integral part of the fabric. This layer will also be referred to subsequently as a reinforcing layer.

According to a possible form of embodiment, the material from which the reinforcing layer is obtained comprises at least one thermoplastic component suitable for retaining the properties of melting and resolidifying each time it is heated and cooled without its physical characteristics being impaired. In more detailed terms, the above-mentioned material comprises a polyurethane mix.

According to a different embodiment, the material which forms the reinforcing layer comprises at least one elastic component. In more detailed terms, this above-mentioned material comprises a silicone mix.

According to a further possible embodiment, and in particular in both the above disclosed embodiments, the material which forms the reinforcing layer also comprises pigments and/or further cosmetic elements.

Figure 2:
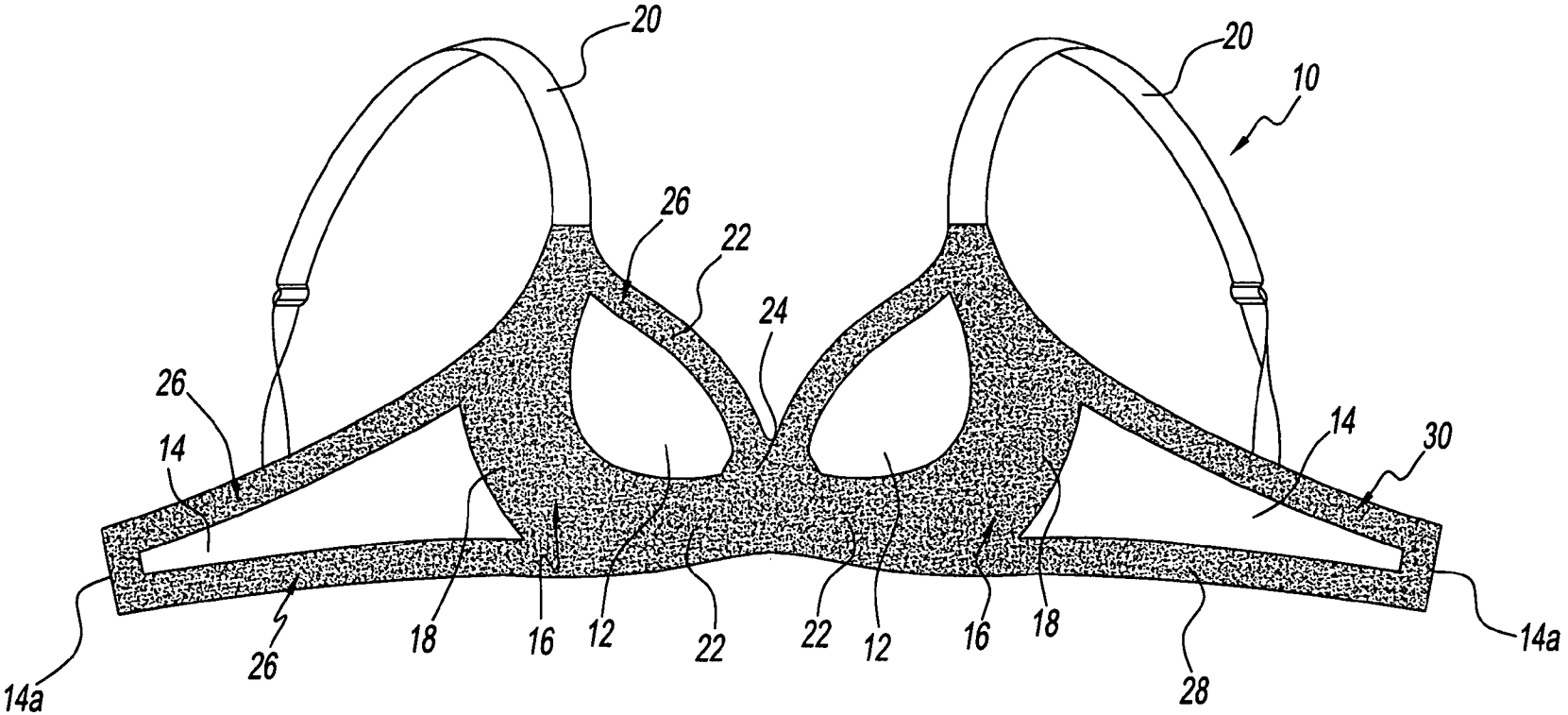
FIG. 2 illustrates a front view partly in perspective of a brassiere according to the present invention.

As shown in FIGS. 1 and 2, the reinforcing layer is applied along a side portion 18 of each of the two cups 12, on the side of the cup edge which faces towards the respective side band 14, forming an integral part of the fabric. In more detail, the above-mentioned layer is applied along the side portion 18 of the cup and extends with no break in continuity at least as far as a point of connection to a shoulder strap 20 or to an upper portion of the brassiere, wrapping around the respective cup at the side.

In the example shown in FIGS. 1 and 2, the above-mentioned reinforcing layer is also applied at least along a lower portion 22 of each cup, forming an integral part of the fabric.

In more detail, the above-mentioned layer is applied along the lower portion 22 of each cup and extends with no break in continuity along the respective side portion 18, wrapping around the respective cup 12 at the bottom and at the side.

In the example in FIGS. 1 and 2, the above-mentioned reinforcing layer also wraps around the two cups with no break in continuity, since the reinforcing layers of each cup meet in the lower portion 22 between the two cups. According to a possible embodiment, the lower portion 22 between the two cups extends slightly towards the upper part of the brassiere in the portion between the two cups 12 and widens towards the sides in the portion between the two cups to form a joining portion 24.

According to a possible embodiment the side portions 18 have a greater width than the lower portions 22 of the above-mentioned layer. In more detailed terms, the width of the reinforcing layer decreases gradually and continuously from the side portions 18 to the lower portions 22 of the above-mentioned layer.

As shown in FIGS. 1 and 2, provision may also be made for further layers 26 of chemical material suitable for being applied along at least an edge portion of the brassiere and for forming an integral part of the fabric. In what follows, the further layers 26 will also be indicated as edge layers.

In more detailed terms, FIGS. 1 and 2 show a brassiere in which a further layer 26 is provided along the whole outer edge of the brassiere comprising a lower edge portion 28, an upper edge portion 30 corresponding to the portion of the sides band, and an upper edge portion 32 corresponding to the brassiere proper. Clearly, other variants may be provided in which the further layer is provided only on part of the edge of the brassiere or is completely absent.

As shown in FIGS. 1 and 2, the above-mentioned further layer 26 is preferably of constant width over all the edges of the brassiere.

According to a possible embodiment, the further layers 26 suitable for being applied along at least an edge portion of the brassiere 10 are produced from the same material as the reinforcing layer 16.

According to a possible embodiment, where the brassiere provides for a further layer 26 applied along at least a lower edge portion 28 of the brassiere, it is particularly advantageous that the latter should be fused with the lower portion 22 of the layer of the reinforcing means, in the area below the cups 12, as shown in FIG. 1, for example.

According to a possible embodiment, where the brassiere provides for a further layer 26 applied along at least an upper edge portion 30 of the side bands 14 it is particularly advantageous that the latter, for at least part of its length, should be fused with the side portion 18 of the layer of the reinforcing means.

According to a possible embodiment, where the brassiere provides for a further layer 26 applied along at least an upper edge portion 32 of the brassiere, it is particularly advantageous that the latter, at least for the end areas, should be fused respectively with the side portion 18 and with the lower portion 22 of the layer of the reinforcing means, for example at the joining portion 24 if present.

According to a possible embodiment, the further layers 26 suitable for being applied along at least an edge portion of the brassiere have a smaller width than the layer 16 of the reinforcing means.

FIG. 1 shows schematically the basic structure of a brassiere 10 according to the invention, while FIG. 2 shows schematically a brassiere 10 provided with shoulder straps 20 of conventional type, made in one piece, for example, or separately and attached subsequently to the structure in FIG. 1.

Figure 3:
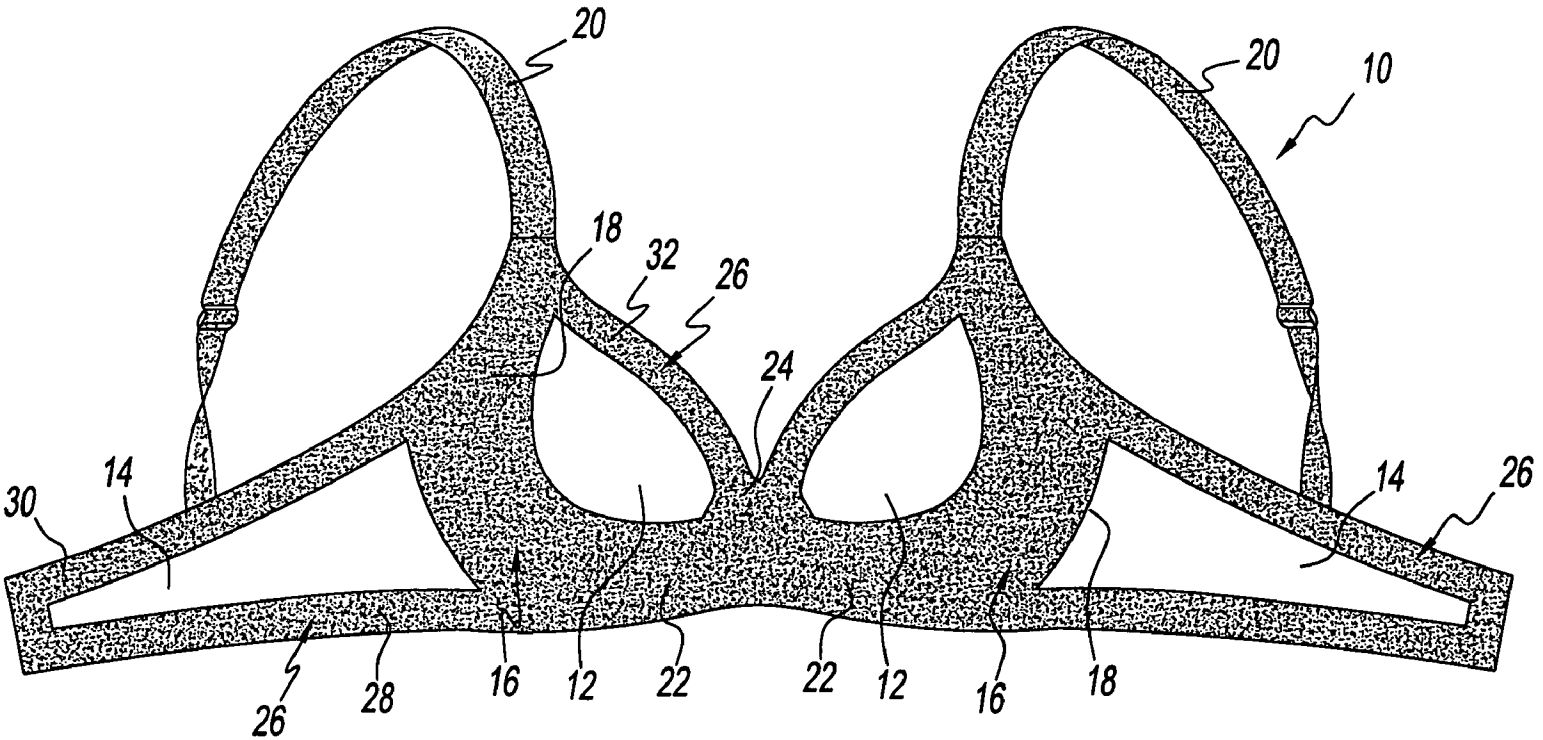
FIG. 3 illustrates a front view partly in perspective of a possible embodiment of the brassiere according to the present invention.
Figure 4:
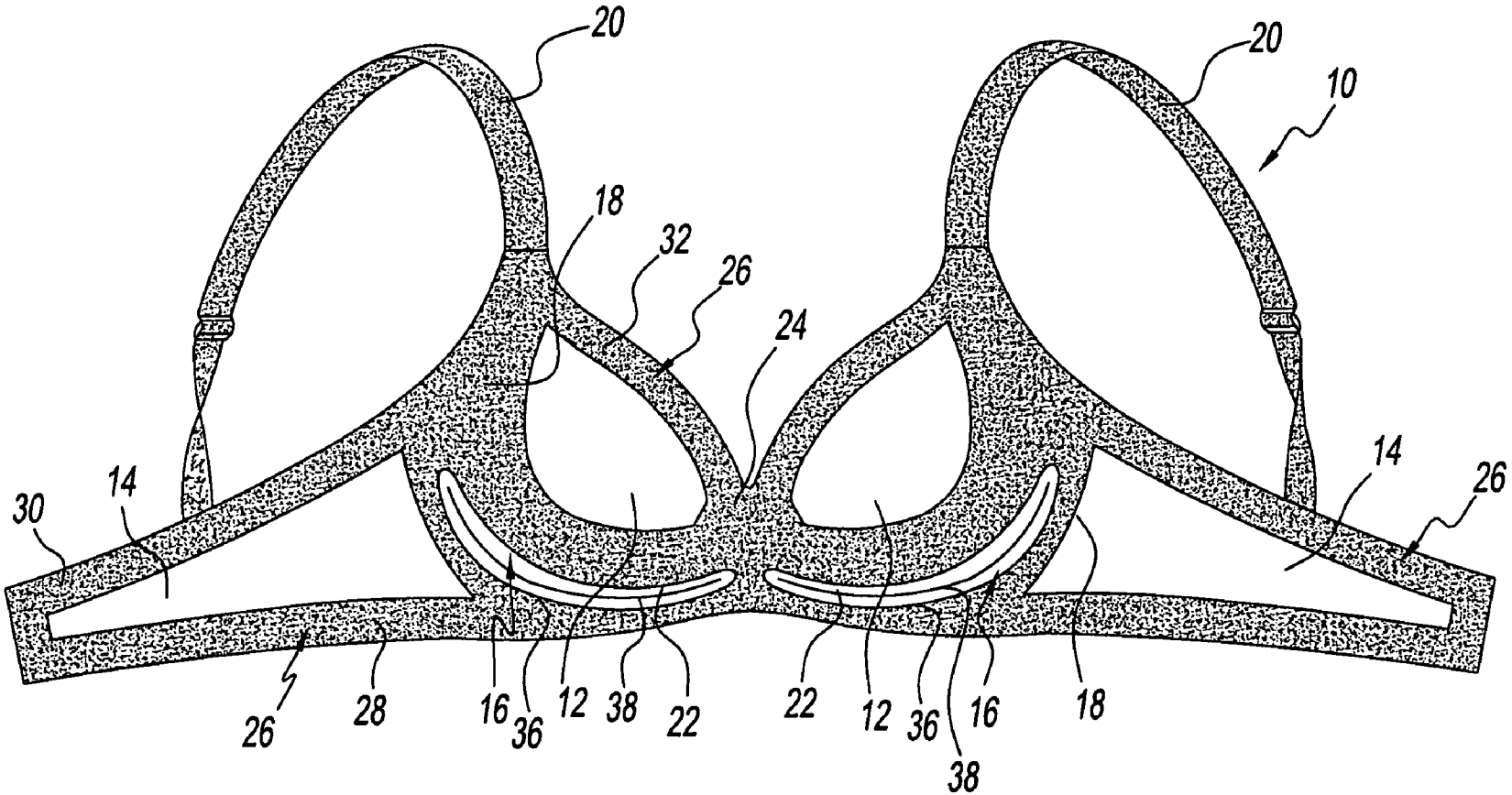
FIG. 4 illustrates a rear view in perspective of the brassiere according to the present invention having a sheath and wire.

According to a further possible embodiment, shown in FIG. 3 for example, the reinforcing means comprise at least one layer 16 of chemical material suitable for being applied along at least a portion of the shoulder straps 20 and for forming an integral part of the fabric.

According to a possible embodiment, shown in FIG. 3 for example, the layer of chemical material extends continuously along at least a portion of the shoulder straps 20 and along a side portion 18 of each cup which faces towards the respective band 14, forming an integral part of the fabric. In more detailed terms, the layer of chemical material applied to the shoulder straps 20 has a smaller width than the layer applied to the side portion 18 of the edge of the cup 12 which faces towards the respective side band 14.

Where both a side portion 18 and a lower portion 22 are provided, the layer extends with no break in continuity from the lower portion 22 to the side portion 18 continuing along the shoulder straps 20, thus wrapping around the respective cup both at the bottom and at the side, and supporting it at the top by means of the shoulder straps.

Even where the shoulder straps provide for a layer of chemical material suitable for becoming an integral part of the fabric, the shoulder straps may be made separately from the brassiere and applied to it or may be produced in one piece with the brassiere.

According to a possible embodiment, where the shoulder straps are applied to the structure of the brassiere, the joining means may advantageously comprise the same layer of material which is made to melt partially so as to weld it.

The layers as described above, both in the case of the reinforcing layer 16 and in the case of the edge layer 26, are printed onto a base fabric of the brassiere. In more detailed terms, the layers are applied to a fabric by means of a screen printing process or advantageously by means of a cylinder printing process.

According to a possible embodiment, the layers described above, and in particular the reinforcing layer, are applied in a uniform thickness, obtained with a single printing step or with several successive steps to obtain sub-layers.

According to further advantageous embodiments, by applying several printing steps, layers with different thicknesses can be obtained on different portions of the brassiere, depending on the strength to be produced.

From the above, it can be appreciated how the provision of a brassiere according to the invention achieves the desired action of supporting and reinforcing the cups, especially at the sides, simply and effectively while reducing the thickened areas and rigid parts found in conventional brassieres.

In particular, a particularly flat, flexible brassiere is obtained without rigid accessories such as wires, while still maintaining an optimum reinforcing and supporting effect.

A measure found to be particularly effective is to produce a continuous reinforcing layer both on the side portion and on the lower portion, especially if this meets between the two cups in a joining portion. This means that there is complete wrapping around the cup without its being rigidly constricted.

Moreover, the provision of an integrated layer in the shoulder straps further improves the reinforcing effect as well as increasing the strength, particularly resistance to wear, of a highly stressed part. In addition to the above, the material integrated in the shoulder straps may have the effect of increasing the friction of these on the shoulders of the wearer, improving wearability.

The combination of reinforcing layers and edge layers, coupled so as to co-operate, to the extent of meeting in certain portions, increases the strength of the whole article and in particular of the points which absorb the stresses to which the reinforcing layers are subject in their supporting action.

A further advantage of the brassiere according to the invention consists in its unusual structural simplicity, which enables it to be produced at very moderate cost. Moreover, for example in case of layers in polyurethane mix, the reinforcing layers and the edge layers have no unfavourable effects on subsequent preforming of the brassiere where this is employed.

It is clear that variants and/or, additions are possible to what is described and illustrated above.

As an alternative to what is shown in FIG. 1, the two cups 12 may be made separately and then joined together by means of connecting elements. In this case, the two lower portions of the layer of reinforcing material are also separate from each other.

As an alternative to what is described in the drawings, the reinforcing layer 16 may comprise only the side portions 18 which face towards the respective side band or only the lower portions 22.

According to a possible embodiment of the brassiere according to the present invention, as an alternative to what is shown in the drawings, the brassiere 10 comprises only reinforcing layers and does not comprise edge layers, or only some portions of these layers.

According to a possible form of one embodiment, the brassiere is not provided with shoulder straps. In this case, side portions may be provided which extend with no break in continuity at least as far as an upper portion of the brassiere, wrapping around the respective cup at the side. In addition wires and/or reinforced edges may be provided to support the cups.

By contrast with what is shown in the drawings, the brassiere may comprise a reinforcing layer 16 for each cup, each independent of the other, i.e. without a joining portion between the two cups.

Moreover, according to another possible embodiment, not shown, the brassiere according to the invention comprises a reinforcing layer applied along the whole surface of each cup, between a lower portion and side portions thereof. Where appropriate, provision may be made for different thicknesses of the material, for example greater along the side and lower portions.

According to a further possible embodiment, not shown, the further layers suitable for being applied along at least an edge portion of the brassiere comprise materials different from the one which forms the reinforcing means, to obtain different properties in the various portions of the brassiere.

According to a further embodiment, not shown, the side bands are suitable for connecting to each other in that they are stitched together or made in one piece from the same fabric to obtain a sports style brassiere.

A further possible embodiment also provides for the reinforcing means to comprise supporting elements, such as wires 38, suitable for being applied to the edges of the cups 12. In particular, the support elements are suitable for being applied to the edges of the cups 12 by sheaths 36 welded to the reinforcing layer preferably by melting it.

For a person skilled in the art, it will be possible to make numerous modifications and adaptations to the preferred form of the embodiments of the brassiere described above and to replace components with other functionally equivalent ones, in order to meet incidental and specific requirements, without thereby departing from the scope of the following claims.

What is claimed is:

1. A brassiere having a pair of cups of fabric, each of said pair of cups being connected to each other, two side bands being releasably connected to each other, one of said two side bands extending from one of said pair of cups and the other of said two side bands extending from the other of said pair of cups, and shoulder straps, the brassiere comprising:

reinforcing means having at least one reinforcing layer of chemical material applied along at least an edge portion of each of the pair of cups and for forming an integral part of the fabric, said reinforcing layer applied along at least a portion of said shoulder straps of the brassiere and for forming an integral part of the fabric, said reinforcing layer applied at least along a side portion of each of said pair of cups, wherein said side portion faces towards the respective band and a lower portion of each of said pair of cups form an integral part of the fabric, said reinforcing layer being applied along said lower portion of each of said pair of cups and extends with no break in continuity into said side portion continuing along said shoulder straps, wrapping around the respective cup at the lower portion and at the side portion for support, and said reinforcing means further comprising wires.

2. The brassiere according to claim 1, wherein said reinforcing layer comprises at least one thermoplastic component.

3. The brassiere according to claim 2, wherein said thermoplastic component comprises a polyurethane mix.

4. The brassiere according to claim 1, wherein said reinforcing layer comprises at least one elastic component.

5. The brassiere according to claim 4, wherein said at least one elastic component comprises a silicone mix.

6. The brassiere according to claim 1, wherein said reinforcing layer comprises pigments and/or cosmetic elements.

7. The brassiere according to claim 1, wherein said reinforcing layer is applied along said side portion of each of said pair of cups and extends with no break in continuity at least as far as the point of connection to a shoulder strap, wrapping around the respective cup at the side.

8. The brassiere according to claim 1, wherein said reinforcing layer wraps around the pair of cups meeting at a lower portion between the pair of cups.

9. The brassiere according to claim 8, wherein said layer meets in said lower portion between said pair of cups extending slightly towards an upper portion of the brassiere and widening towards the sides in the portion between said pair of cups.

10. The brassiere according to claim 1, wherein said side portions of said reinforcing layer have a greater width than said lower portions of said reinforcing layer.

11. The brassiere according to claim 10, wherein the width of said layer decreases gradually and continuously from said side portion to said lower portion of said reinforcing layer.

12. The brassiere according to claim 1, wherein said reinforcing layer is applied along the whole surface of each of said pair of cups, between said lower portion and said side portions of the pair of cups.

13. The brassiere according to claim 1, further comprising a further layer of chemical material applied along at least an edge portion of the brassiere and for forming an integral part of the fabric.

14. The brassiere according to claim 13, wherein said further layer is applied along at least a lower edge portion of the brassiere and at least part of the length of said further layer is fused with said lower portion of said reinforcing layer.

15. The brassiere according to claim 13, said further layer is applied along at least an upper edge portion of said two side bands and, for at least part of the length of said further layer, is fused with said side portion of said reinforcing layer.

16. The brassiere according to claim 13, wherein said further layer is applied along at least an upper edge portion of the brassiere and, at least for the end areas, is fused with said side portion of each of said pair of cups and with said lower portion of said reinforcing layer.

17. The brassiere according to claim 13, wherein said further layer is applied along at least an edge portion of the brassiere and has a smaller width than said reinforcing layer.

18. The brassiere according to claim 13, wherein said further layer is applied along at least an edge portion of the brassiere and comprises the same material as said reinforcing layer.

19. The brassiere according to claim 1, wherein said reinforcing layer has a portion that is applied to said shoulder straps that has a smaller width than a portion of said reinforcing layer applied to said side portion which faces towards the respective band.

20. The brassiere according to claim 1, wherein said shoulder straps are produced separately from the brassiere and applied to it by melting said reinforcing layer.

21. The brassiere according to claim 1, wherein said shoulder straps are made in one piece with the brassiere.

22. The brassiere according to claim 1, wherein said reinforcing layer is printed onto the fabric.

23. The brassiere according to claim 22, wherein said reinforcing layer is applied to the fabric by a screen printing process.

24. The brassiere according to claim 22, in which said reinforcing layer is applied to the fabric by a cylinder printing process.

25. The brassiere according to claim 1, wherein said reinforcing layer is applied in a uniform thickness.

26. The brassiere according to claim 1, wherein said reinforcing layer is applied in different thicknesses to different portions depending on the strength to be produced.

27. The brassiere according to claim 1, wherein said reinforcing layer comprises at least two sub-layers.

28. The brassiere according to claim 1, wherein said wires are applied to the edges of said cups.

29. The brassiere according to claim 28, wherein said wires are applied to the edge of said pair of cups by sheaths welded to said reinforcing layer by melting said reinforcing layer.

* * * * *